United States Patent [19]

Eck et al.

[11] 3,953,711

[45] Apr. 27, 1976

[54] COOKING UNITS

[75] Inventors: Walter Eck, Munich; Walter Heywang, Neukeferloh, Munich, both of Germany

[73] Assignee: E.G.O. Elektro-Geraete Blanc und Fischer, Oberderdingen, Germany

[22] Filed: Nov. 4, 1974

[21] Appl. No.: 520,959

[30] Foreign Application Priority Data

Nov. 6, 1973 Germany ..... 2355412

[52] U.S. Cl. ..... 219/464; 219/465; 219/505; 219/543; 338/22 R

[51] Int. Cl.[2] ..... H05B 3/68

[58] Field of Search ..... 219/216, 462, 463, 464, 219/543, 465, 505; 338/22 R, 22 SD, 217, 218

[56] References Cited

UNITED STATES PATENTS

| | | | |
|---|---|---|---|
| 2,710,900 | 6/1955 | Linder | 338/217 X |
| 3,067,311 | 12/1962 | Lacy-Hulbert | 219/552 |
| 3,375,774 | 4/1968 | Fujimura et al. | 338/22 R X |
| 3,400,250 | 9/1968 | Buiting et al. | 219/441 |
| 3,406,279 | 10/1968 | Ziver | 219/464 |
| 3,413,442 | 11/1968 | Buiting et al. | 219/553 X |
| 3,466,423 | 9/1969 | Jannings | 219/216 |
| 3,496,336 | 2/1970 | Hingorany et al. | 219/464 |
| 3,551,644 | 12/1970 | Sano et al. | 219/441 |
| 3,636,309 | 1/1972 | Deaton et al. | 219/463 X |
| 3,644,864 | 2/1972 | Hirsbrunner et al. | 338/22 SD X |

OTHER PUBLICATIONS

*Journal of The American Ceramic Society*, "Resistivity Anomaly in Doped Barium Titanate," by W. Heywang, pp. 484–490, Oct. 1964, Vol. 47, No. 10.

*Siemens-Zeitschrift*, "Kaltleiter als Flussigkeitsstandfuhler" 39th Vol., Feb. 1965, part 2, pp. 138–145.

*Primary Examiner*—C. L. Albritton

*Attorney, Agent, or Firm*—Brumbaugh, Graves, Donohue & Raymond

[57] ABSTRACT

An electrical cooking unit comprising a cover on which cooking can take place, heating resistors in the form of PTC resistor elements being distributed over the underside of the cover, the PTC resistor elements being made of a PTC resistor material, the resistance of which varies as a step function of temperature, and being distributed over the underside of the cover to provide zones on the cover of varying energy density and/or varying step temperature of the PTC resistors.

8 Claims, 2 Drawing Figures

FIG.1
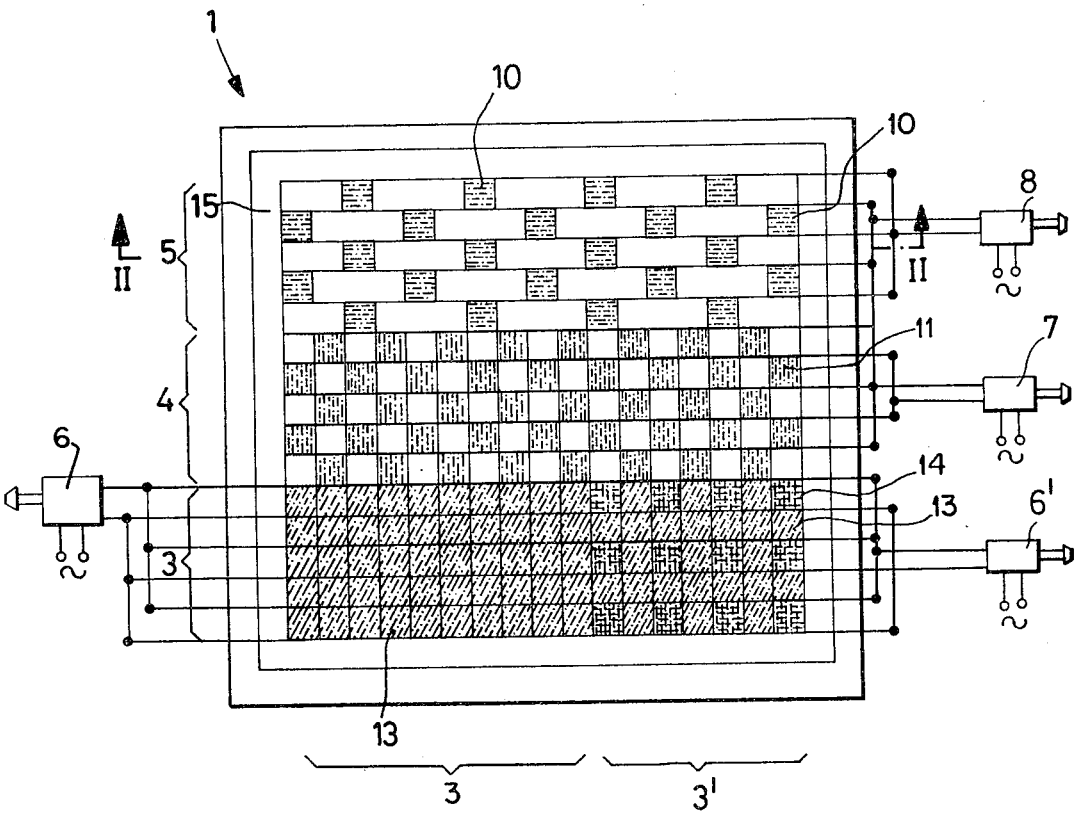
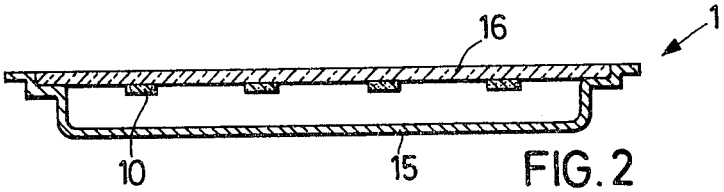
FIG. 2

COOKING UNITS

The present invention relates to an electrically heated cooking unit having heating resistors disposed beneath a cover.

BACKGROUND OF INVENTION

In known cooking units, which are used in kitchen stoves ranges or the like and which may, for example, have a glass ceramic plate as the cover, conventional heating resistors in the form of heating windings are disposed on the underside of the cover. This does, however, have the disadvantage that the cooking unit is heated only in the region of the heating resistors and thus, in the same manner as with the conventional cooking plates, there are produced only narrowly defined points for the transmission of heat from the heating resistor to the substance which is being cooked. Furthermore, in such arrangements it is necessary to have at least one anti-overheating switch for each heating resistor. However, additional temperature regulators are also widely used.

SUMMARY OF THE INVENTION

An object of the invention is to provide a cooking unit or stove of the initially-described type, which can be heated at least over a large part of its total surface, thereby saving on the expense of anti-overheating resistors.

This object is solved in accordance with the present invention in that there is provided an electrical cooking unit or stove comprising a cover on which cooking can take place, heating resistors in the form of PTC resistor elements being distributed over the underside of the cover, the PTC resistor elements being made of a PTC resistor material the resistance of which varies as a step function of temperature, and being distributed over the underside of the cover to provide zones of varying energy density and/or varying step temperature of the PTC resistors.

This arrangement of PTC resistors results in a stove plate having a similar distribution of temperature on the upper surface as is known in the case of stoves which are heated by solid fuels. The use of antiheating switches is made superfluous by the increase in the resistance level of the PTC resistors which are used, said increase occurring with the step temperature, and substantial energy is supplied only to those surfaces where energy is collected. The other surfaces are kept at the step temperature, that is they are kept in readiness, by a small supply of energy.

It is particularly advantageous when the zones having differing energy density or differing step temperature of the PTC resistors are individually switchable and the zones are sub-divided into individually switchable power steps. In a preferred embodiment of the invention the PTC resistors in the individual power steps differ from one another in respect of their step temperature.

Finally, it is also possible within the bounds of the invention to mix PTC resistors of differing step temperatures within the individual zones. This measure makes it possible for cooking to be commenced using a high energy supply, followed by automatic switching back to a smaller supply of energy in the region of the boiling point of water, so that a temperature regulator is not required.

BRIEF DESCRIPTION OF THE DRAWINGS

The present invention will now be further described, by way of example with reference to the accompanying drawings, in which:

FIG. 1 shows a top plan view of one embodiment of a cooking unit or stove constructed according to the present invention with the cover removed, and FIG. 2 shows a section through the cooking unit shown in FIG. 1, along the line II—II.

DESCRIPTION OF THE PREFERRED EMBODIMENTS

A cooking unit or stove 1 is illustrated in the accompanying drawings. The cooking unit 1 comprises a flat sheet-metal trough 15 and a cover 16 made of glass ceramic which is disposed above said trough, the glass ceramic being glasslike material which is resistant to high temperatures, PTC resister elements 10, 11, 13 and 14, being disposed beneath the cover 16. The cover 16 can also be made of metal. In the embodiment shown the PTC resistors elements 10 to 14 are disposed in zones 3, 3′, 4 and 5 with differing energy density. If necessary, the various zones may be separated by electrical insulation 17 between the respective (cold conductor) PTC resistor elements.

The PTC resistors which are used are made of barium titanate or barium lead titanate, as for example in the "Journal of the American Ceramic Society" in the article, entitled "Resistivity Anomaly in Doped Barium Titanate" (Vol. 47, No. 10, Oct. 1964, pages 484 – 490). One property of this PTC resistors material is that at a certain temperature (step temperature), it is able suddenly to increase its resistance, which is relatively low when the material is cold. The magnitude of the step temperature can vary depending on the composition of the starting materials (see also "Siemens-Zeit-schrift", article entitled "Kaltleiter als Flussigkeitsstandfuhler" ("Cold conductors as liquid level detectors"), 39th volume, Feb. 1965, part 2, pages 138 – 145). Mains voltage is supplied to the PTC resistors by way of switching devices 6, 6′, and 8, each of which ensures that a zone can be switched on or off independently of the other zones. Zones 3 has the highest energy density and serves as the roasting and commencement of cooking zone. In this zone the PTC resistor elements, which are in the form of square plates in the embodiments, are disposed directly adjacent to one another, so that they cover the entire underside of the glass ceramic cover 16. In this zone, PTC resistors 13 with a relatively high step temperature, e.g. of 350°C are used, so that the temperature of the cover is adjusted to approximately this value. PTC resistor elements having higher step temperatures may also be used.

On the right of FIG. 1 and adjoining this zone 3, a zone 3′ is provided which serves as a special zone for commencement of cooking. In this zone the PTC resistors are again disposed so that they are closely adjacent, that is with the greatest energy density, but PTC resistors 13 having a high step temperature and PTC resistors 14 having a lower step temperature are used alternatively. This zone enables a largely automatic commencement of cooking. The step temperature of the PTC resistor elements 14 is adjusted in such a manner that when a cold pan is placed thereon, it is again effective in heating said pan. With their relatively low resistance when cold, both PTC resistor elements 13 and 14 initially act as heating resistors, and thus heat the underside of a pan which is placed thereupon. The step temperature of the PTC resistor elements 14 is adjusted in such a manner that said elements reach their high resistance shortly before the water in the cooking vessel reaches its boiling point. The heating elements 14 then switch off automatically owing to a sudden increase in their resistance, and it is then only the heating elements 13 which serve to continue cooking the substance. The higher step temperature of the PTC resistor elements 13 which nevertheless is still not in a dangerous temperature range, ensures that there is no risk of burning. The ratio of PTC resistor elements 13 having a higher step temperature to elements 14 having a lower step temperature can also differ from the ratio of 1 : 1 which is shown. Particularly where commencement of cooking is concerned, substantially more elements 14 having a lower step temperature can be provided.

PTC resistor elements 11 having a medium step temperature e.g. of 200°C, are disposed in a central continuation of cooking zone 4, which extends in the form of a strip over the cooking unit or stove. In this zone the energy density is also reduced by the PTC resistor elements being disposed in chessboard fashion, so that there is an empty square between every two PTC resistor elements, both longitudinally and crosswise. Therefore only 50% of the underside of the cover has elements disposed thereupon. This zone serves to continue cooking.

Adjacent to this zone is a warm zone 5, possessing PTC resistor elements 10, which have a very low step temperature, e.g. of only 70° or 80°C, these elements 10 being arranged to provide a relatively small energy density in this zone. This relatively small energy density is achieved by there being between every two PTC resistors a gap whose size is equivalent to three-times the dimensions of the PTC resistors. Therefore only approx. 25% of the cover is occupied by elements in the zone 5 and foods which are to be kept warm may be placed on this zone.

All four zones can be switched on or off independently of each other, so that they can also be used individually. The mode of operation is usually planned so that a cooking vessel or pot, heated for example in zone 3 or 3' until the contents reach boiling point, is then pushed onto zone 4 so that cooking can be continued and, upon termination of the cooking process, is pushed onto zone 5 until the contents are served. The PTC resistors also ensure that a greater supply of energy is provided only to that region where the cooking vessel is standing. The other surfaces are kept at the step temperature, it is true, but are only very slightly heated, because there is no drop in energy. The power is therefore regulated automatically. Just as the temperature drops below the step temperature as a result of a drop in energy, so the resistance becomes lower and heating is effected, until the step temperature is exceeded and practically causes the heating element to be switched off again. Rather than the variation in the resistance being fully effected in a step, a relatively gentle transition takes place.

It should be recognised that the energy density and the step temperature can be varied either individually or both together. It is also possible to subdivide the individual zones into individually switchable power steps, so that if, for example, one wishes to place only one cooking vessel on a zone, the whole zone does not have to be heated. Numerous modifications can also be effected with regard to the spatial arrangement of the individual zones in accordance with the purpose for which they are to be used. The cooking unit according to the invention may, for example, be incorporated in the form of a so-called stove trough into a set of kitchen furniture and is particularly suitable in this connection since the step temperature property of the PTC resistor elements prevents dangerously high temperatures from being produced which could cause a danger of burning.

The level of the respective step temperature is determined in dependence on the circumstances, and also particularly in dependence on what type of upper cover is provided. With a metal cover, for example, the step temperature is in the order of magnitude of the desired cooking temperature, whilst being set at a somewhat higher level in the case of a glass ceramic plate, in order to take into account the drop in temperature through the glass ceramic plate.

We claim:

1. An electrical cooking unit for a stove comprising a substantially flat and heat transmissive cover on which cooking can take place; heating resistors in the form of PTC resistor elements being distributed over and mounted on the underside of the cover to provide a plurality of cooking zones of different energy density; and electrical circuit means, connected to the PTC resistor elements, for applying a voltage thereto; the PTC resistor elements being made of a material having a resistance which increases as a step function with increasing temperature, the step increases occurring at a particular temperature called the step temperature.

2. An electrical cooking unit for a stove comprising a substantially flat and heat transmissive cover on which cooking can take place; heating resistors in the form of PTC resistor elements being distributed over and mounted on the underside of the cover; and electrical circuit means, connected to the PTC resistor elements, for applying a voltage thereto; the PTC resistor elements being made of a material having a resistance which increases as a step function with increasing temperature, the step increase occurring at a particular temperature called the step temperature, said PTC resistor elements being distributed over the underside of the cover so as to provide a plurality of cooking zones of different step temperature.

3. A cooking unit according to claim 1, wherein the zones are connected individually to electrical switching devices and can be switched independently of one another.

4. A cooking unit according to claim 2, wherein the zones are connected individually to electrical switching devices and can be switched independently of one another.

5. A cooking unit according to claim 3, wherein individual regions within the zones can be switched independently of one another.

6. A cooking unit according to claim 4, wherein individual regions within the zones can be switched independently of one another.

7. A cooking unit according to claim 1, wherein PTC resistor elements having different step temperatures are mixed in at least one of said zones.

8. A cooking unit according to claim 2, wherein PTC resistor elements having different step temperatures are mixed in at least one of said zones.

* * * * *

UNITED STATES PATENT AND TRADEMARK OFFICE

CERTIFICATE OF CORRECTION

PATENT NO. : 3,953,711

DATED : April 27, 1976

INVENTOR(S) : Walter Eck and Walter Heywang

It is certified that error appears in the above-identified patent and that said Letters Patent are hereby corrected as shown below:

Column 2, line 41, "6,6' and 8," should read --6,6', 7 and 8--.

Signed and Sealed this

Twenty-first Day of December 1976

[SEAL]

*Attest:*

RUTH C. MASON
*Attesting Officer*

C. MARSHALL DANN
*Commissioner of Patents and Trademarks*